US006279313B1

(12) United States Patent
Lawen, Jr. et al.

(10) Patent No.: US 6,279,313 B1
(45) Date of Patent: Aug. 28, 2001

(54) COMBUSTION LINER FOR GAS TURBINE HAVING LINER STOPS

(75) Inventors: James L. Lawen, Jr., White, GA (US); Saim Dinc, Troy; Salvadore Calabrese, Clifton Park, both of NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/461,091

(22) Filed: Dec. 14, 1999

(51) Int. Cl.[7] ..... F02C 7/20
(52) U.S. Cl. ..... 60/39.31; 60/39.32; 60/752
(58) Field of Search ..... 60/39.31, 39.32, 60/752

(56) References Cited

U.S. PATENT DOCUMENTS

| | | | | |
|---|---|---|---|---|
| 3,316,714 | * | 5/1967 | Smith | 60/39.65 |
| 4,132,066 | | 1/1979 | Austin, Jr., et al. . | |
| 4,292,810 | | 10/1981 | Glenn . | |
| 4,392,355 | | 7/1983 | Verdouw . | |
| 4,454,711 | | 6/1984 | Ben-Porat . | |
| 4,614,082 | | 9/1986 | Sterman et al. . | |
| 4,773,227 | | 9/1988 | Chabis . | |
| 4,875,339 | | 10/1989 | Rasmussen et al. . | |
| 4,955,191 | | 9/1990 | Okamoto et al. . | |
| 5,083,424 | * | 1/1992 | Becker | 60/39.31 |
| 5,125,227 | | 6/1992 | Ford et al. . | |
| 5,749,218 | | 5/1998 | Cromer et al. . | |
| 5,775,589 | * | 7/1998 | Vdoviak | 239/127.1 |

* cited by examiner

*Primary Examiner*—Timothy S. Thorpe
*Assistant Examiner*—Ehud Gartenberg
(74) *Attorney, Agent, or Firm*—Nixon & Vanderhye P.C.

(57) ABSTRACT

In a gas turbine combustion system, liner stops mount a combustion liner within a flow sleeve. The liner stops are mounted on the outer surface of the combustion liner and the inner surface of the flow sleeve in a symmentrical array of liner stops. The liner stops have inclined contacting surfaces that support the liner within the sleeve, and provide rubbing contact between the two. These inclined surfaces are on a post of a male liner stop that fits into a channel of a female liner stop.

8 Claims, 5 Drawing Sheets

COMBUSTION LINER FOR GAS TURBINE HAVING LINER STOPS

BACKGROUND OF THE INVENTION

This invention relates to combustion chambers in gas turbine engines. In particular, the invention relates to the mounting and alignment of combustion liners within the combustion chambers of gas turbines.

The combustion system of a gas turbine generates hot gases to drive a turbine. The turbine, in turn, drives a compressor that provides compressed air for combustion in the combustion system. In addition, the turbine produces usable output power. A combustion system for a gas turbine may be configured as a circular array of combustion chambers arranged to receive compressed air from the compressor, inject fuel into the compressed air to create a combustion reaction, and generate hot combustion gases for the turbine. Each cylindrical combustion chamber includes one or more fuel nozzles, a combustion zone within the combustion liner, a flow sleeve surrounding and radially spaced from the liner, and a gas transition duct between the combustion chamber and turbine.

The combustion zone is a volume within the combustion liner in which the fuel/air mixture combusts to generate the hot gases. Compressed air flows from the compressor to the combustion zone through an annular gap between the combustion liner and flow sleeve. Air flowing through this gap cools the outer surface of the liner and flows into the combustion zone through holes in the combustion liner. Compressor air flows between the liner and flow sleeve in a first direction, reverses direction as it enters the combustion liner, and flows as a hot gas in an opposite direction out of the liner and combustor, and to the turbine.

The combustion liner operates in a high temperature environment in which a roaring combustion process generates a stream of high-velocity hot gases that flow through the liner and to the turbine. Heat and vibration from the combustion processes, as well as other mechanical loads and stresses from the gas turbine shake, rattle and otherwise vibrate the combustion liner flow sleeve and the other components of the combustion chamber. Accordingly, the combustion liner should be mounted in the flow sleeve to withstand the heat, vibration and loads imposed by the combustion of gases and other forces that act on the combustion chamber.

Liner stops mount the combustion liner concentrically within the combustion flow sleeve. Three liner stops are typically arranged around on the outer surface of the combustion liner, and bridge a gap between the liner and flow sleeve. Each liner stop on the combustion liner mates with a matching liner stop on an inside surface of the flow sleeve. The liner stops align the liner within the flow sleeve, and with respect to the fuel nozzles and other components of the combustion chamber.

Prior liner stops have had difficulty in aligning the combustion liner in the flow sleeve, especially during assembly of the combustion system. During assembly, the combustion liner is inserted into the cylindrical flow sleeve. The liner stops on the combustion liner fit into the matching liner stops in the flow sleeve. Due to the close tolerances in the fit of liner stops, the stops have had to be precisely aligned as the liner is inserted into the flow sleeve. A misalignment between the liner and flow sleeve often resulted in the liner stops not properly fitting together, and required reassembly or resulted in a defective assembly of the liner and sleeve. The requirement for precise alignment of the combustion liner, slows and complicates the assembly process for a combustion system. In addition, the potential for misalignment between the combustion liner and flow sleeve has resulted in a relatively-high number of defects in combustion systems.

The liner stops support the liner during the extreme vibration and heat that result from combustion within the combustion liner. Vibration and thermal deformations due to the combustion process cause the liner, flow sleeve, and other components of the combustor to vibrate and otherwise move with respect to each other. In particular, the combustion liner thermally deforms and vibrates with respect to the flow sleeve and fuel nozzle. Accordingly, the liner stops should maintain the alignment between the liner, sleeve and flow nozzle despite the vibration forces and deformation inherent in a combustion system.

Prior combustion liner stops suffered from excessive wear of their contacting surfaces. The contact surfaces in liner stops are those surfaces of the male and female stops that are in rubbing contact when the liner is in the flow sleeve. The contacting surfaces in the liner stops support the weight of the combustion liner, and transfer vibration and other dynamic forces between the liner and flow sleeve. These contacting surfaces should also withstand the wear that results as these surfaces rub together. As the liner stops rub together, the contacting surfaces wear away and the fit between these surfaces loosens. As the surface fit loosens, the magnitude of vibration between the liner stops increases because there is more space for the liner stops to rattle against each other. During operation of the combustion system, the liner stops may develop a wear cycle of increasing surface wear, which allows for greater vibratory movements between the liner stops, and which in turn causes even more surface wear.

The vibration/wear cycle of the liner stops can continue until the contacting surfaces wear through and the liner stops fail. When liner stops wear through and fail, the wearing surfaces in the combustion chamber may shift away from the liner stops to other surfaces that are not intended to be in rubbing contact. Similarly, unintended contact between surfaces in the combustion chamber may result due to misalignment as the combustion liner is inserted into the flow sleeve. If the wearing surfaces in a combustor shift away from the liner stops, then the surfaces of, for example, the combustion liner and fuel nozzles may come into rubbing contact. The surfaces of the liner and fuel nozzle are not designed or intended to support the combustion liner or to withstand the rubbing wear that occurs during vibration. When the contacting surfaces shift from the liner stops to other combustor chamber components, the cycle of wear and vibration may continue rapidly until the combustor fails, or until a sufficient clearance develops between the new rubbing surfaces to give way and allow the rubbing surfaces to transfer back to the liner stops or other combustor component. Even when the rubbing contact shifts back to the liner stops, wear damage to the liner, nozzles or other combustion components may cause premature failure of the combustion chamber.

Excessive wear between the liner stops, combustion liner and flow sleeves requires frequent maintenance inspections of the liners and stops and can lead to combustor failure. In the past, excessive wear of liner stops has necessitated that gas turbines be regularly shut down to inspect and replace worn combustion components and, in particular, liner stops. These inspections incur high labor costs, require expensive part replacements, and result in lost power generation from the shut-down gas turbines. Accordingly, there is a long-felt need for combustion liner stops that allow for easy alignment of the combustion liner and flow sleeve during assembly, provide vibration resistant support for the sleeve and do not fail due to vibratory wear.

BRIEF SUMMARY OF THE INVENTION

Novel liner stops have been developed that mount a combustion liner within the flow sleeve of a combustion chamber. The liner stops ease the alignment of the combustion liner in the flow sleeve, and lock the liner in alignment with the sleeve. The liner stops are also tolerant of vibration and wear, and do not allow their contacting surfaces to become loose or to shift due to rubbing wear. As the liner stops wear, the contacting surfaces in the liner stops remain tightly seated together, so that the combustion liner is continuously aligned within the flow sleeve.

The liner stops are symmetrically arranged around the outer surface of the cylindrical combustion liner, and the inner surface of the flow sleeve. Male liner stops may be arranged on the combustion liner, and seat in female liner stops on the flow sleeve. Alternatively, the female liner stops may be on the combustion liner and the male liner stops may be on the flow sleeve. The male liner stop has a wedged post that slides into and engages a tapered channel of the female liner stop. As the inclined sidewalls of the post seat on the inclined sidewalls of the channel, the male and female liner stops are aligned and locked together. The liner stops are self-locking to hold the liner in the flow sleeve. The inclined surfaces of the post of the male liner stop to form a tight friction fit with the inclined surfaces of the channel of the female liner stops. The alignment and self-locking features of the liner stops reduce the wear of the liner stops, and avoid prior problems associated with earlier liner stops.

The liner stops provide for easy assembly of the combustion liner and flow sleeve. The wedged-shaped post of the male liner stop has a narrow leading face and a wide trailing section. The channel of the female liner stop is wide at its entrance and tapers to a narrow rear wall. The channel mouth of the female liner stop easily accepts the narrow leading face of the male liner stop with a relatively generous clearance between the sides of the channel entrance and the male liner stop. This clearance provides a wide tolerance in the required alignment of the combustion liner as liner is inserted into a flow sleeve. In addition, other embodiments of the liner stops have other arrangements of contacting surfaces to provide for easy assembly and a self-locking arrangement.

DETAILED DESCRIPTION OF THE INVENTION

Figure 1:
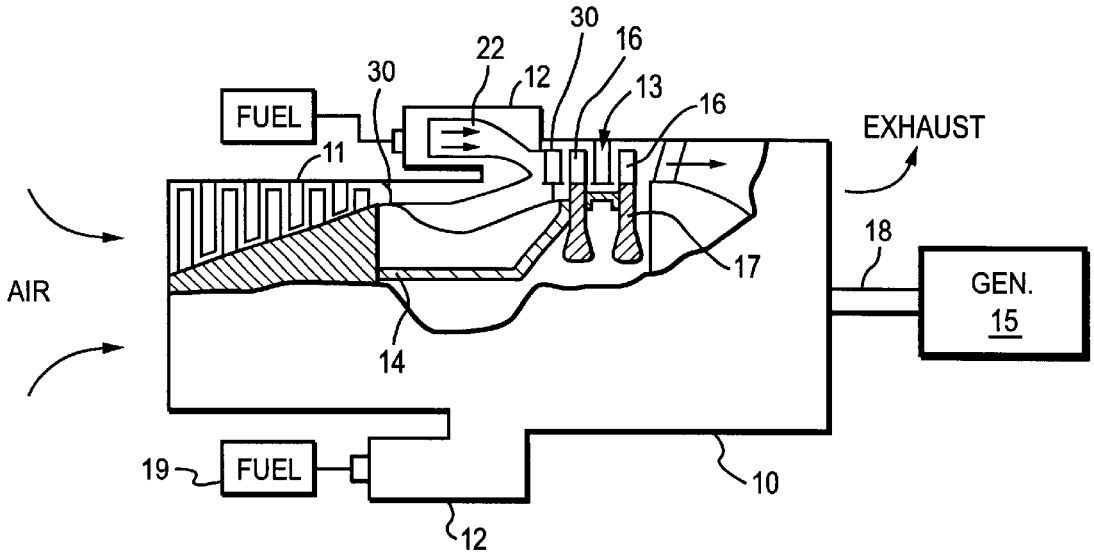
FIG. 1 shows an exemplary gas turbine having a combustion system, having a cut-away section to show the internal components of the gas turbine.

The gas turbine engine 10 depicted in FIG. 1 includes a compressor 11, combustion system 12, and a turbine 13, all disposed about a rotatable shaft(s) 14. Atmospheric air enters the gas turbine to be pressurized, heated and expelled to provide usable power output, such as to drive an electric generator 15. The compressor 11 provides pressurized air to the combustion system 12. Fuel from a fuel system 19 is mixed with the pressurized air in the combustion chamber to generate combustion gases and heat energy. The combustion gases are ducted from the combustion chamber to the turbine. The combustion gases flow through an annular array(s) of turbine blades 16 mounted on disks 17 which rotate the shaft(s) 14. The rotation of the shaft(s) 14 turns the compressor 11, which in turn compresses the air to feed the combustion process. The rotation of the shaft(s) 14 also provides a power output 18 from the gas turbine to the generator 15 or other system.

Figure 2:
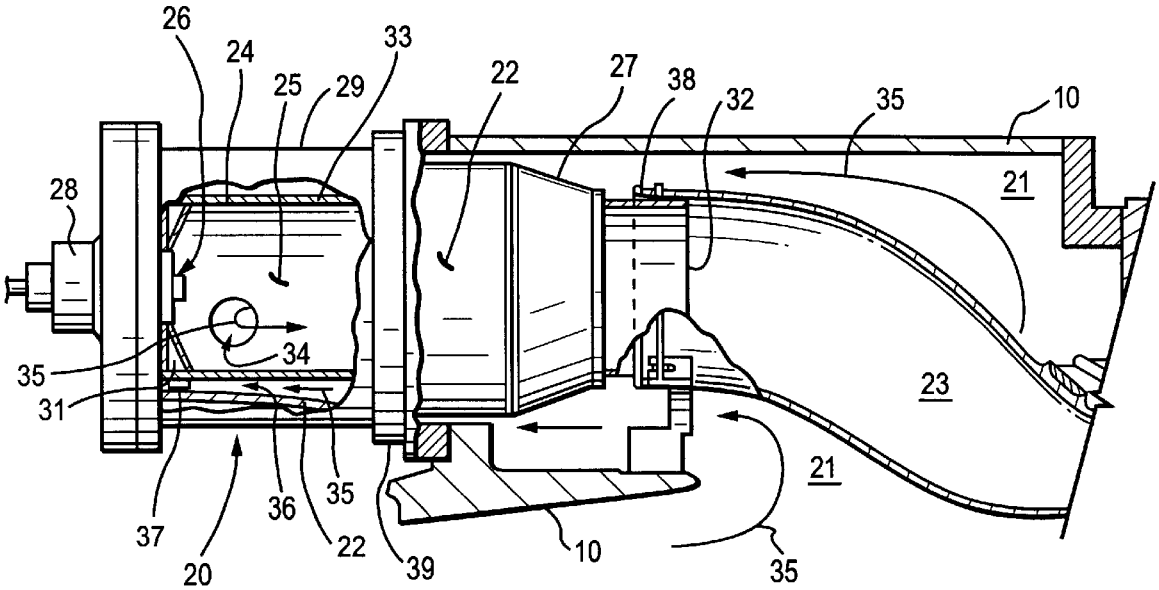
FIG. 2 is a close-up view of the combustion system shown in FIG. 1, such that the internal components of the combustion chamber are shown in a cut-away section of the figure.
Figure 3:
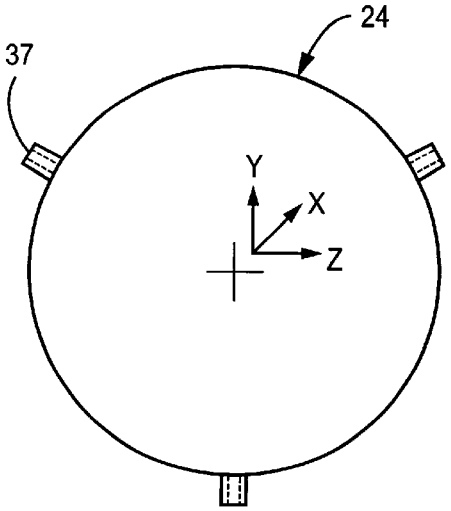
FIGS. 3 and 4 show end and side views of a combustor liner.
Figure 4:
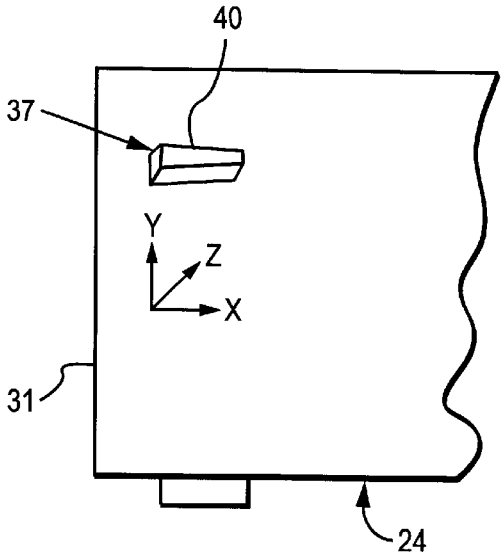
Figure 5:
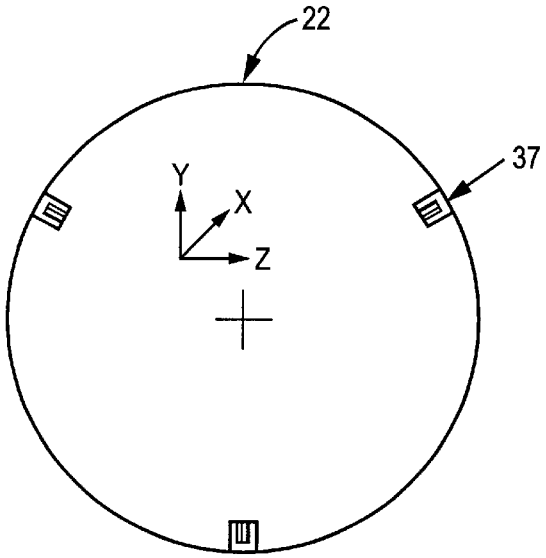
FIGS. 5 and 6 show end and side views of a flow sleeve.
Figure 6:
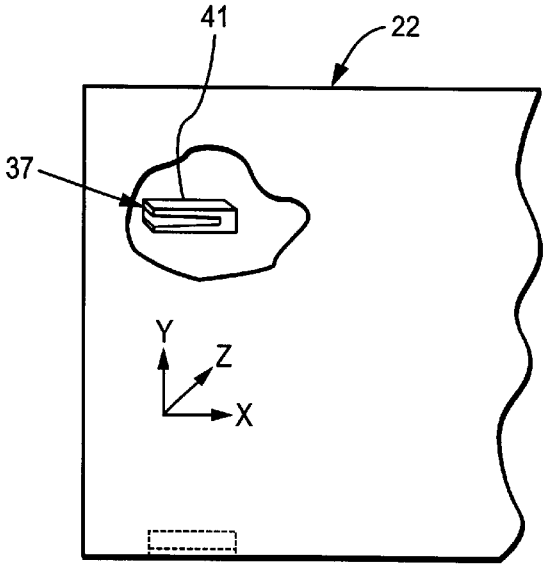

FIG. 2 shows one combustion chamber 20 that is part of the circular array of similar combustion chambers around the center of a gas turbine that forms the combustion system 12. The combustion chamber 20 includes a compressed air inlet duct 21, a flow sleeve 22, and a combustion gas exhaust duct 23 to direct combustion air to the turbine. The flow sleeve 22 houses a cylindrical combustion liner 24 that houses a combustion zone 25.

A cylindrical combustion casing 29 houses each of the combustion chambers 22, and attaches the chamber to a housing 30 of the gas turbine. The combustion liner 24 is coaxially mounted within the flow sleeve 22. The liner and sleeve are both coaxially mounted within the combustor casing 29. The flow sleeve is mounted in the combustion casing 29 by mounting brackets 39.

The combustion liner 24 is a cylinder having an inlet end 31 aligned with the fuel nozzle 26, and an exhaust end 32 coupled to the duct 23 for combustion gases. A cylindrical wall 33 of the combustion liner defines the combustion zone 25. The wall 92 includes air apertures 34 to allow compressed air to flow into the combustion zone for combustion and cooling. A fuel injection nozzle 26 is at an inlet end 31 of the liner 24. Fuel is provided to the nozzle through a fuel inlet port 28.

Compressed air 35 flows from the compressor 11 to the air duct 21 of the combustion chamber 22, and passes through the annular air passage 36 formed between the combustion liner 24 and flow sleeve 22. The air flowing through the air passage 36 cools the combustion liner and enters the combustion zone 25 via the air apertures 34 and at the inlet of the combustion liner, that is adjacent the fuel nozzle(s) to be mixed with fuel for combustion.

The combustion liner 24 is supported in the flow sleeve 22 by liner stops 37, adjacent the inlet end 31 of the liner. The combustion liner is also supported by a coupling 38 that attaches the exhaust end 32 of liner to the exhaust duct 23.

As is shown in FIGS. 3 to 6, the liner stops 37 are symmetrically arranged around the outer surface of the cylindrical combustion liner 24. Similarly, an arrangement of mating liner stops are symmetrically arranged on the inside surface of the flow sleeve. Three male liner stops 40 may be arranged on the combustion liner 24 and female liner stops 41 may be arranged on the flow sleeve 22, or vice versa. As the combustion liner fits into the flow sleeve, the male liner stops on the liner slide into and engage the female liner stops on the flow sleeve. The male and female liner stops engage when contacting surfaces on the male liner stop seat against opposite contacting surfaces of the female liner stops. An x-y-z coordinate symbol is provided in FIGS. 3 to 15 to indicate the orientation of the liner stops with respect to the combustion liners and flow sleeves.

Figure 7:
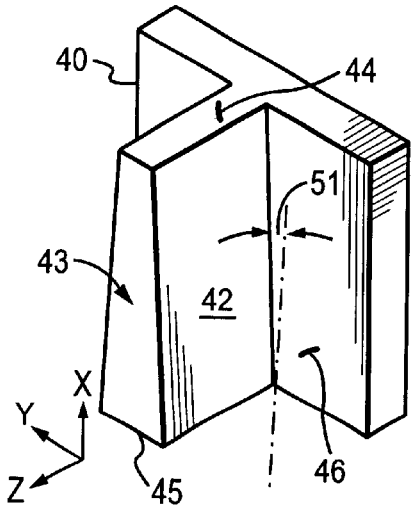
FIGS. 7, 8 and 9 are schematic diagrams of a male liner stop, a female liner stop, and an assembly of male and female line stops, respectively, which illustrate a first embodiment of the invention.
Figure 8:
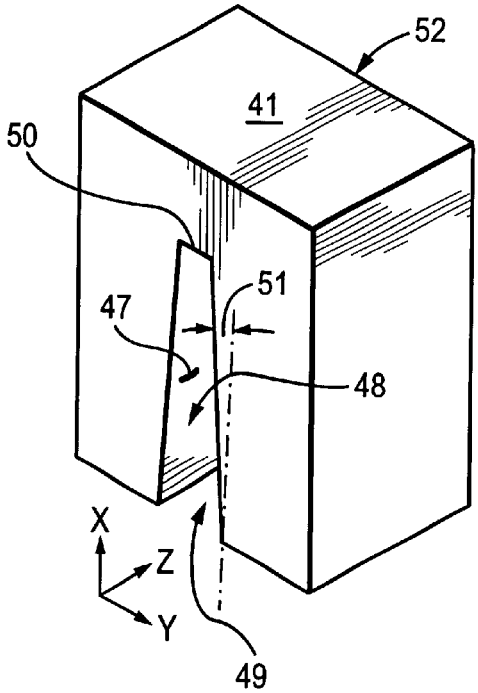
Figure 9:
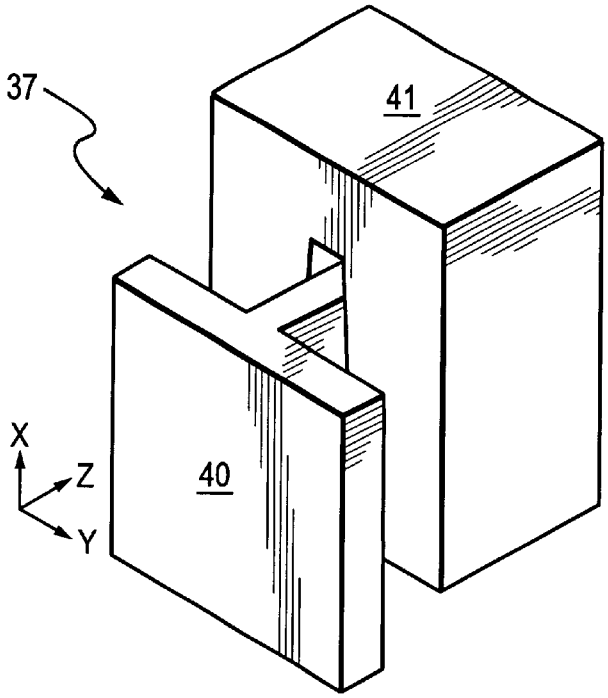

As shown in FIGS. 7 to 9, the liner stops 37 are self-locking and hold the combustion liner 24 in proper alignment within the flow sleeve 22. The male liner stops 40 and female liner stops 41 have inclined surfaces that slide against each other to lock the liner stops together, and to mount the combustion liner in the flow sleeve. The inclined surfaces 42 on the male liner stop 40 are opposite sides of a tapered post 43, and extend from a narrow leading edge 44 of the post to the wide trailing edge 45. A base 46 of the male liner stop supports the post 43, and serves as an attachment for the male liner stop 41 to the combustion liner or flow sleeve. The inclined surfaces 47 on the female liner stop 41 are on opposite sides of a channel 48 formed in that liner stop. The channel 48 has a wide entrance 49 that tapers to a narrow end 50. The female liner stop 41 may be formed of, for example, a cobalt super-alloy, nickel super-alloy, stainless steel or carbon steel. The back-side 52 of the female liner stop serves as the attachment surface to the flow sleeve or combustion liner.

During insertion of the combustion liner into the flow sleeve, as the male liner stop 40 slides into the female liner stop 41 along the X-direction, such that the wedged post 42 slides into the narrowing channel 47. The liner stops slide together until the inclined surfaces 42, 47 abut, and post 43 can enter the channel 48 no farther. When the post 43 is fully seated in the channel 48, the male and female liner stops are locked together by the friction between the contacting inclined surfaces 42, 47 of the post and channel.

The leading edge 44 of the post 43 on the male liner stop 40 is wider than the narrow end 50 of the channel 50 of the female liner stop 41 so that the leading edges does not abut against the end 50 of the channel. Conversely, the leading edge 44 of the post is substantially narrower than the width of the entrance 49 of the channel 48 to provide a generous clearance for the insertion of the post into the channel. This clearance allows for relatively-easy insertion of the combustion liner into the flow sleeve.

The friction between the male liner post and female liner channel provides an axially-locking force to hold the combustion liner axially in the flow sleeve. The liner may be also biased inward to the flow sleeve by a spring force or other similar force to ensure that the liner stops are continually fully engaged and locked together.

Compensation for wear between the male and female liner stops is automatic because the male and female liner stops are biased together. As the rubbing surfaces of the liner stops wear, the liner stops slide further together to ensure that they remain locked together. As the liner stops slide farther together, the inclined surfaces 42, 47 of the stops again form a tight, locking engagement. Accordingly, the wear of the liner stops is minimized because the male and female stops always fit snugly together. The liner stops, thus, avoid excessive vibration and wearing due to a loose fit.

The male and female liner stops maintain a zero clearance for motion laterally (y-direction) and/or transverse (z-direction), as is shown in FIG. 9. When the male liner stop 40 is seated in the female liner stop 41, the inclined surfaces 42 on the male post 43 are in contact with the opposite inclined surfaces 47 of the female channel 48. These inclined surfaces provide a relatively-large contacting surface area over which the weight of the combustion liner is distributed. The inclined contacting surfaces prevent movement in the y and z directions between the liner stops and, thus, between the flow sleeve and combustion liner. Movement is limited to the insertion direction (x-direction), and even that movement stops when the liner stops are seated together. The contacting surface area is also beneficial for distributing the vibration and other dynamic forces that are transferred between the flow sleeve and combustion liner.

The angle of the incline surfaces of the liner stops affects the locking force between the male and female liner stops. The inclined surfaces should obey the relationship shown in equation 1, below:

$$\tan(\alpha) < \mu \tag{1}$$

where $\alpha$ (51) is the angle of the incline of the contacting surfaces 42, 47 on the male and female liner stops. In addition, $\mu$ is the friction coefficient between these contacting surfaces, which is a property of the material and surface texture of the liner stops. Setting the incline angle $\alpha$ such that its tangent is less than the friction coefficient ensures that the liner stops will not easily slide apart. The liner stops can be "unlocked", i.e., slide apart, if a sufficient axial load is applied to pull the male liner stop out of the female liner stop along the x-direction. The incline angle $\alpha$ and coefficient of friction $\mu$ may be selected to provide a desired balance of the locking and unlocking forces for each combustion liner design. A small incline angle would require a large force to unlock the liner stops, and a large incline angle allows for unlocking of the liner stops.

Figure 10:
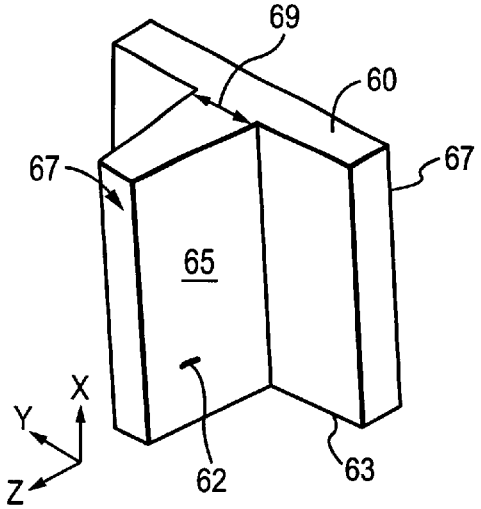
FIGS. 10, 11 and 12 show schematic diagrams of a male liner stop, a female liner stop, and an assembly of male and female liner stops, respectively, which illustrate a second embodiment of the invention.
Figure 11:
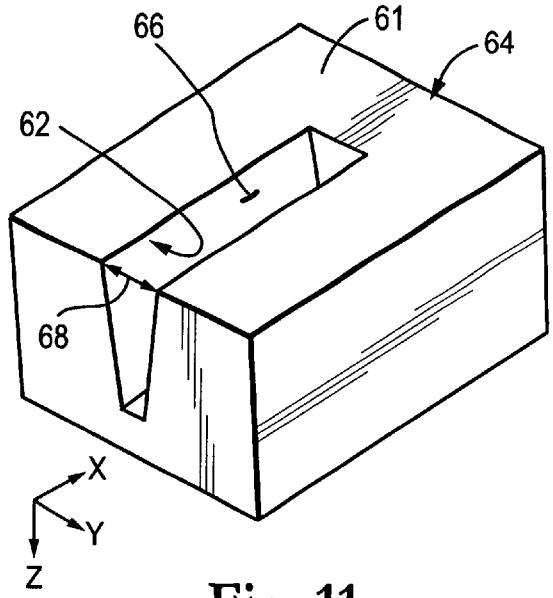
Figure 12:
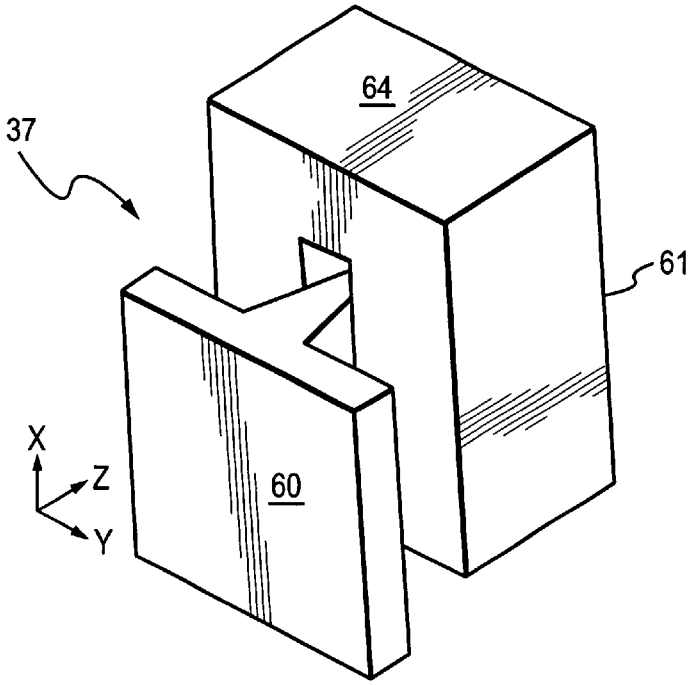

FIGS. 10, 11 and 12 show a male liner stop 60, female liner stop 61, and an assembly of the two. The incline surfaces 62 of these stops increase along the lateral length (z-direction ) of the combustion liner. In contrast the incline surfaces 42 of the first embodiment of the liner stops (shown in FIGS. 7 to 9) are inclined with respect to the x-direction.

The male liner stop 60 may mounted in an upright manner with its bottom edge 63 attached to the outer surface of the combustion liner. Similarly, the female liner stop 61 has a top surface 64 that is attached to the inner surface of the flow sleeve. As the combustion liner is inserted into the sleeve, the poet 65 of tho male liner stop slides into the channel 66 of the female liner stop.

The top edge 67 of the post is narrow and easily fits into the wide slot entrance 68 to the channel 66. The post widens from its leading edge 67 to its base 69, along the z-direction. The widening of the post provides the incline to the contacting surface 65 of the post that seats against the opposing inclined surface 65 of the channel. The slope of the incline of these contact surfaces should be selected to obey equation (1), above. The liner stops 60, 61 lock the combustion liner in the x- and y-directions. The axial motion (z-direction) of the liner stops is reduced by the zero mating clearance between the conducting surfaces.

Alternatively, the liner stops shown in FIGS. 10, 11 and 12 may be attached to the combustion liner and flow sleeve in the same manner as the first embodiment shown in FIGS. 7 to 9. Specifically, the backside of the base 67 of the male liner stop 60 is attached to the combustion liner, and the backside of the female liner stop is attached the flow sleeve.

Figure 13:
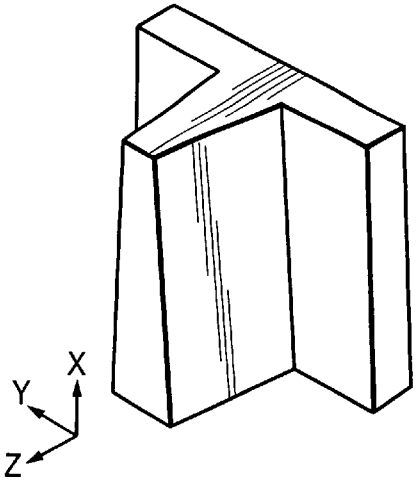
FIGS. 13, 14 and 15 show schematic diagrams of a male liner stop, a female liner stop, and an assembly of male and female liner stops, respectively, which illustrate a third embodiment of the invention.
Figure 14:
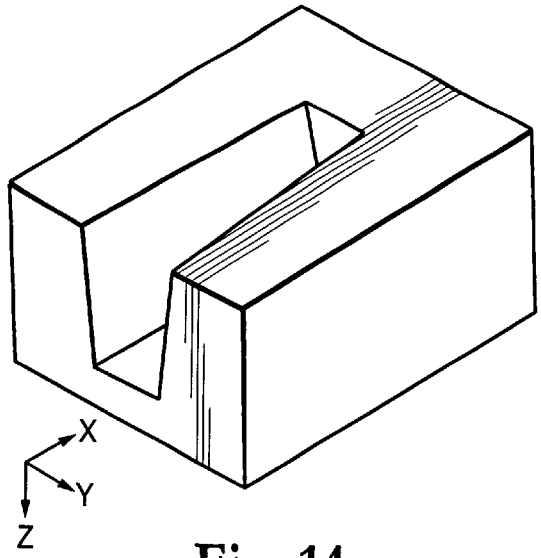
Figure 15:
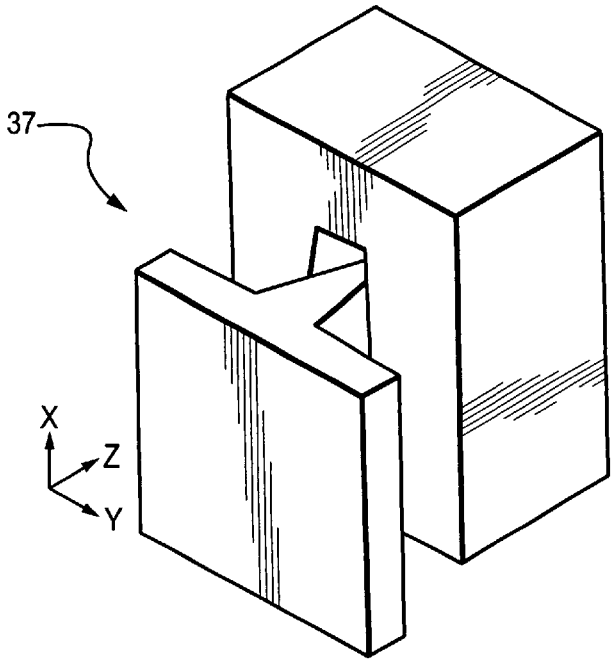

FIGS. 13, 14 and 15 show a third embodiment of a male liner stop 70, female liner stop 71 and assembled male and female liner stops, respectively. The third embodiment of the liner stops combines the incline surfaces of the first and second embodiments. In particular, the incline surfaces 72 of the third embodiment liner stops have a two-dimensional incline in which the surfaces 72 are inclined with respect to both the x-direction and the z-direction. In this embodiment, the inclined surfaces of the liner stops slope in two directions, i.e., the x- and z-directions. The two angles of the inclined surfaces 72 may be selected so as to conform to equation (1) above.

The invention has been described in connection with what is considered to be the most practical and preferred embodiment. The invention is not limited to the disclosed embodiment, but rather covers the various modifications and equivalent arrangements included within the spirit and scope of the appended claims.

What is claimed is:

1. A combustion system in a gas turbine comprising:

a combustion liner having a longitudinal axis and defining a combustion zone, said liner having an outer surface with a coupling member extending outward from the liner;

a combustor flow sleeve which houses and is coaxially aligned with said combustion liner, said flow sleeve having an inner surface with a mating coupling member extending inward from the flow sleeve, and said coupling member of the flow sleeve having a pair of inclined surfaces that are inclined relative to the longitudinal axis to engage opposite inclined surfaces on the mating coupling member of said combustion liner.

2. A combustion system as in claim 1 wherein the coupling member and the mating coupling member are mating liner stops.

3. A combustion system as in claim 1 wherein the coupling member is a male liner stop with a post having opposite sides that form the inclined surfaces, and the mating coupling member is a female liner stop having a channel having opposite sidewalls that form the opposite inclined surfaces.

4. A combustion system as in claim 1 wherein the inclined surfaces and the opposite inclined surfaces have a common slope and a common coefficient of friction, and a tangent of the slope is less than the coefficient of friction.

5. A combustion system as in claim 4 wherein the common slope of the inclined surfaces is further inclined in a radial direction to the combustion liner.

6. A combustion chamber in an annular array of combustion chambers in a gas turbine, where the combustion chamber comprises:

a flow sleeve having an inner surface and a longitudinal axis;

a combustion liner coaxially arranged within the inner surface of the flow sleeve;

a male liner stop mounted on an outer surface of the combustion liner or an inner surface of the flow sleeve, the male liner stop having a post with opposite sidewalls, and each sidewalls inclined from a leading edge of the sidewalls to a trailing edge of the sidewalls;

a female liner stop mounted on the inner surface of the flow sleeve or the outer surface of the combustion liner, the female liner stop having a channel to receive the post of the male liner stop, and the channel having opposite sidewalls inclined from an entrance to the channel to the end of the channel, and wherein the opposite sidewalls of the post of the male liner stop are in rubbing contact with the opposite sidewalls of the channel of the female liner stop and inclined relative to said longitudinal axis.

7. A combustion chamber as in claim 6 wherein the sidewalls of the post of the male liner stop and the sidewalls of the channel of the female liner stop have a common slope and a common coefficient of friction, and a tangent of the slope is less than the coefficient of friction.

8. A combustion chamber as in claim 7 wherein the common slope of the male liner stop and of the female liner stop is further inclined a radial direction to the combustion liner.

* * * * *